US010669670B2

(12) United States Patent
Stout

(10) Patent No.: US 10,669,670 B2
(45) **Date of Patent: *Jun. 2, 2020**

(54) ROPE HAVING A SPLICED EYE, CORRESPONDING METHOD OF FORMING AN EYE AND USE OF THE ROPE

(71) Applicant: LANKHORST TOUWFABRIEKEN B.V., Sneek (NL)

(72) Inventor: Adrianus Stout, Alblasserdam (NL)

(73) Assignee: Lankhorst Touwfabrieken B.V., Sneek (NL)

( * ) Notice: Subject to any disclaimer, the term of this patent is extended or adjusted under 35 U.S.C. 154(b) by 190 days.

This patent is subject to a terminal disclaimer.

(21) Appl. No.: 15/857,459

(22) Filed: Dec. 28, 2017

(65) Prior Publication Data

US 2018/0119342 A1 May 3, 2018

Related U.S. Application Data

(60) Continuation of application No. 14/582,029, filed on Dec. 23, 2014, now Pat. No. 9,856,600, which is a (Continued)

(30) Foreign Application Priority Data

Dec. 10, 2009 (NL) ..... 2003939

(51) Int. Cl.
*D07B 1/18* (2006.01)
*D07B 7/18* (2006.01)
(Continued)

(52) U.S. Cl.
CPC ..... *D07B 1/185* (2013.01); *D07B 1/148* (2013.01); *D07B 7/16* (2013.01); *D07B 7/18* (2013.01);
(Continued)

(58) Field of Classification Search
CPC ..... D07B 1/148; D07B 1/185; D07B 7/16; D07B 7/18; B65H 69/06
See application file for complete search history.

(56) References Cited

U.S. PATENT DOCUMENTS 2,304,306 A 12/1942 Hobbs, Jr.
2,414,664 A 1/1947 Peterson
(Continued)

FOREIGN PATENT DOCUMENTS

CH 446960 A 11/1967
DE 20052013476 U1 12/2005
(Continued)

OTHER PUBLICATIONS

International Search Report dated May 16, 2011 for PCT Patent Application No. PCT/NL2010/050843, 3 pages.
(Continued)

*Primary Examiner* — Shaun R Hurley
(74) *Attorney, Agent, or Firm* — Kilpatrick Townsend & Stockton LLP

(57) ABSTRACT

Rope having an eye. The rope comprises a first rope portion and a second rope portion. The first rope portion and the second rope portion are spliced into each other for forming a spliced connection for obtaining the eye. The first rope portion and the second rope portion are formed from an end portion of the rope.

31 Claims, 9 Drawing Sheets

Related U.S. Application Data division of application No. 13/514,567, filed as application No. PCT/NL2010/050843 on Dec. 10, 2010, now Pat. No. 8,955,299.

(51) Int. Cl.
*D07B 1/14* (2006.01)
*D07B 7/16* (2006.01)

(52) U.S. Cl.
CPC ..... *D07B 2201/2009* (2013.01); *D07B 2201/2083* (2013.01)

(56) References Cited

U.S. PATENT DOCUMENTS

| | | | |
|---|---|---|---|
| 2,454,592 | A | 11/1948 | Budzinski |
| 2,575,974 | A | 11/1951 | Peterson |
| 2,967,391 | A | 1/1961 | Himick et al. |
| 3,008,287 | A | 11/1961 | Crandall |
| 3,013,463 | A | 12/1961 | Gathman et al. |
| 3,067,570 | A | 12/1962 | Nischan |
| 3,118,273 | A | 1/1964 | Lucht |
| 3,181,907 | A | 5/1965 | O'Donnell |
| 3,276,810 | A | 10/1966 | Antell |
| 3,411,400 | A | 11/1968 | Morieras et al. |
| 3,472,121 | A | 10/1969 | Johansen |
| 3,475,897 | A | 11/1969 | Leach |
| 3,537,742 | A | 11/1970 | Black |
| 3,932,697 | A | 1/1976 | Hood |
| 4,043,581 | A | 8/1977 | St Germain |
| 4,114,360 | A | 9/1978 | Emmons |
| 4,215,463 | A | 8/1980 | Crook |
| 4,225,172 | A | 9/1980 | Marquardt |
| 8,955,299 | B2 | 2/2015 | Stout |
| 9,856,600 | B2 * | 1/2018 | Stout ..... D07B 1/148 |
| 1,334,244 | A1 | 3/2020 | Howe |

FOREIGN PATENT DOCUMENTS

| | | | |
|---|---|---|---|
| EP | 0 012 406 | A1 | 6/1980 |
| GB | 957961 | A | 5/1964 |
| GB | 1 480 826 | | 7/1977 |
| JP | S52143447 | U3 | 10/1977 |
| JP | S5438947 | A | 3/1979 |
| WO | 2005/054710 | A1 | 6/2005 |

OTHER PUBLICATIONS

International Preliminary Report on Patentability dated Jun. 21, 2012, from PCT Application No. PCT/NL2010/050843 (9 pages).
Office Action dated Feb. 11, 2014, from U.S. Appl. No. 13/514,567 (8 pages).
Examination Report dated May 15, 2014, from European Application No. 10803405.9 (4 pages).
Notice of Allowance dated Sep. 23, 2014, from U.S. Appl. No. 13/514,567 (6 pages).
Examination Report dated Mar. 25, 2015, from European Application No. 10803405.9 (5 pages).
Examination Report dated Feb. 12, 2016 in European Patent Application No. 10803405.9 (6 pages).

* cited by examiner

ROPE HAVING A SPLICED EYE, CORRESPONDING METHOD OF FORMING AN EYE AND USE OF THE ROPE

CROSS-REFERENCE TO RELATED APPLICATIONS

This application is a continuation application of U.S. application Ser. No. 14/582,029, filed Dec. 23, 2014 (U.S. Pat. No. 9,856,600, issue date Jan. 2, 2018), which is a divisional application of U.S. application Ser. No. 13/514,567, filed Aug. 16, 2012, (now U.S. Pat. No. 8,955,299, issued Feb. 17, 2015), which also claims priority to U.S. National Phase Application No. PCT/NL2010/050843, filed Dec. 10, 2010, which claims ultimate priority to the Netherlands Application No. 2003939, filed Dec. 10, 2009, the disclosures of all which are incorporated by reference herein.

FIELD OF THE INVENTION

The invention relates to a rope having an eye, the rope comprising a first rope portion and a second rope portion that are spliced into each other for forming a spliced connection for obtaining the eye. The invention also relates to a method of forming an eye in a rope. The invention further relates to use of a rope.

BACKGROUND

Such ropes having an eye are used in many industrial fields. By for example arranging the eye around a pillar or a hook or bollard that is attached to an object, a towing force can be exerted on the object. Ropes with an eye are frequently used in maritime applications, such as for towing or anchoring of ships or of floating platforms. In such applications the eye is important, as without the eye the rope can hardly be used for towing or anchoring. Obtaining the eye is a classic art wherein the second rope portion is formed from an end of the rope and the first rope portion is located at a distance from the end of the rope, measured along the rope. The second rope portion is then spliced in the first rope portion for forming the spliced connection. The distance between the first and second rope portion then approximately equals the circumference of the eye.

In practice however, it turns out that after having obtained the eye, the spliced connection forms a rather vulnerable part of the rope. As a result of for example grinding of the rope, e.g. against the ship or the floating platform, the spliced connection can wear out rapidly and may damage. Ultimately this may lead to failure of the connection, which can give rise to dangerous situations. This risk has existed already for a long time and attempts have been made to solve it, however without much success. For example, protective materials have been applied around the spliced connection. However, these protective materials themselves can wear out rapidly as well so that the problem of wear of the connection arises again. In addition, applying such protective materials increases cost and weight of the rope and also decreases handling flexibility of the rope.

It is therefore an object of the invention to provide an improved rope having an eye.

SUMMARY

The invention provides a rope having an eye, the rope comprising a first rope portion and a second rope portion that are spliced into each other for forming a spliced connection for obtaining the eye, wherein the first rope portion and the second rope portion are formed from an end portion of the rope. In this way a spliced connection can be obtained that has a reduced thickness compared to known prior art ropes. A thinner spliced connection significantly decreases a vulnerability of the rope for damage e.g. due to grinding. For a relatively thick spliced connection a chance to grind against other objects is relatively high.

Additionally, the relatively thick spliced connection of known prior art ropes forms a rather stiff part of the rope. Without the relatively thick spliced connection of known prior art ropes, a handling flexibility of the rope may be increased.

The term 'splicing' may comprise a broad range of methods, which may be known as such, of interconnecting the first and second rope portion to each other, such as weaving, braiding, twisting, sliding, and the like. Hence, splicing may comprises weaving and/or braiding the first and second rope portion into each other. Such splicing may enable forming a relatively strong spliced connection. Patent application EP 0 012 406 shows a rope having an eye that is formed by means of clamps. In the rope described by EP 0 012 406, the clamps are needed for fixing rope ends that are partly winded around each other.

The first and second rope portion are formed from an end portion of the rope. This means that, before splicing, the first rope portion and the second rope portion may terminate at a rope end. In other words, before splicing, the rope may extend from the first rope portion in only one direction along the rope and may be discontinued in the other direction along the rope. Also, before splicing, the rope may extend from the second rope portion in only one direction along the rope and may be discontinued in the other direction along the rope. Preferably, before splicing, the first rope portion and the second rope portion are located approximately in parallel along the rope. Preferably, a terminating part of the eye comprises the first and second rope portion.

Preferably, the spliced connection extends along at least part of the eye. This can be achieved for example by directing the first rope portion and the second rope portion in different directions along the eye. In this way a rather smooth eye can be obtained, while the relatively thick spliced connection can be prevented. Alternatively, the first rope portion and the second rope portion can be directed in substantially the same directions along the eye.

In an embodiment, the spliced connection extends along the at least part of the eye at least between mutually opposing parts of the eye. In this embodiment an imaginary straight line from the first rope portion to the second rope portion may cross a region outlined by the eye. Thus, the spliced connection may extend from one of the mutually opposing parts to the other one of the mutually opposing parts. Preferably, the spliced connection has a curved shape. In this embodiment, a length of the spliced connection is extended so that a strength of the spliced connection may be increased.

In an embodiment, the spliced connection extends along substantially the whole eye. In this way a thickness of the eye is approximately constant over substantially the whole eye. Tests performed by the inventor showed that an eye spliced in this way can be of comparable strength as, or can even be significantly stronger than, a conventional eye. At the same time, the thickening of the spliced connection typical for known prior art ropes, can be substantially prevented. Additionally, for the rope in this embodiment the tests surprisingly showed that rope parts shoot away after failure in a different way than for known prior art ropes. Without wanting to be bound by any theory, this is believed to be related to the improved formation and/or position along the eye of the spliced connection. For known prior art ropes, many accidents happen each year in which users of the rope are injured severely by the rope parts that shoot away after rope failure. The users may for example lose a body part in such accidents. For the rope according to this embodiment, and also for other ropes according to the invention, the way the rope parts shoot away after failure is considered more favourable. It is therefore expected that an amount of the accidents can be reduced when using the rope of this embodiment. More in particular, in the tests failure often occurred in one of the eye branches relatively close to a branching point from which the two eye branches emanate out of a base part of the rope. Then, after failure, the failed branch of the eye may shoot away around a pillar around which the eye was arranged before failure. This is believed to release a significant amount of energy before the failed rope shoots back towards to other end of the rope, thereby reducing the energy amount in the failed rope. As a result, the base part of the rope may shoot away less violently which may reduce the amount and/or severance of accidents.

In an embodiment, the first rope portion is approximately equal to the second rope portion. In this way, preferably, a length of the first rope portion may be approximately equal to the second rope portion, a tensile strength of the first rope portion may be approximately equal to the second rope portion, a thickness and/or cross section of the first rope portion may be approximately equal to the second rope portion, and/or a composition of the first rope portion may be approximately equal to the second rope portion. This may improve a symmetry of the eye, i.e. the eye is similar along both eye branches that emanate from a base part of the rope. Such an improved symmetry decreases a chance that the eye is weaker along one eye branch than along the other eye branch. This may improve a distribution of mechanical stress in the eye during use of the rope. More in particular, the stress distribution may be more even. In this way a strength of the eye may be improved. Hence, a thickness and/or cross section of the first rope portion and the second rope portion may be approximately equal and/or similar. It may be clear that the thickness and/or cross section of the first rope portion and the second rope portion may be approximately equal and/or similar when the first rope portion and the second rope portion are spliced into each other. Said thickness of the first rope portion may be defined by a maximum distance between outer parts of the first rope portion with the first rope portion and the second rope portion being spliced into each other, said distance being measured in a direction perpendicular to a direction along which the spliced connection extends. Said thickness of the second rope portion may be defined by a maximum distance between outer parts of the second rope portion with the first rope portion and the second rope portion being spliced into each other, said distance being measured in a direction perpendicular to a direction along which the spliced connection extends. It may be clear that, when the cross section of the first rope portion and the second rope portion are approximately equal and/or similar, a total area of the first rope portion along a plane of the cross-section and a total area of the second rope portion along a plane of the cross-section may be approximately equal and/or similar. It may further be clear that, when the cross section of the first rope portion and the second rope portion are approximately equal and/or similar, a distribution and/or pattern of the first rope portion along a plane of the cross-section and a distribution and/or pattern of the second rope portion along the plane of the cross-section may be approximately equal and/or similar. Said plane of the cross-section may be perpendicular to a direction along which the spliced connection extends at a position of the cross-section.

It may be clear though that, in an embodiment, the first rope portion may be different from the second rope portion. For example, the first rope portion may have a thickness and/or strength that is different from a thickness and/or strength of the second rope portion. Such an embodiment may offer the advantage that an eye branch where failure occurs may be predicted. In this way, a direction in which the parts of the rope shoot away after failure can be better predicted. This may improve safety of the user of the rope. Optionally, the rope and/or the eye may comprise an indication which is the weaker and/or stronger branch of the eye. Optionally, the rope and/or the eye may comprise an indication of an expected direction in which the rope parts shoot away after failure.

The rope may optionally be provided with a plurality of strands. Each strand of the rope may e.g. contain a plurality of yarns that extend along a length of the strand. A strand may comprise multiple yarns. A yarn may comprise multiple fibers. The fibers can e.g. be made from natural and/or synthetic material. The strands may for example be braided, woven, twisted, substantially parallel or otherwise interconnected, resulting in e.g. a twisted or braided rope. In addition, a single strand itself may comprise multiple substrands itself that can be braided or twisted or substantially parallel or woven or otherwise interconnected as well, e.g. resulting in a plaited rope. Also, a single strand itself may comprise yarns that can be braided or twisted or woven or otherwise interconnected to form the strand. A rope may also be a non-stranded rope, i.e. may comprise yarns not forming strands. The yarns then may be braided, twisted, woven, substantially parallel or otherwise interconnected.

The rope provided with a plurality of strands may comprise a core that extends along a length of the rope. For a rope comprising strands, the strands may surround the core of the rope. For a non-stranded rope, i.e. a rope comprising yarns, the yarns may be arranged around the core. It may be clear that the invention is not limited to these types of ropes and many other types of ropes and/or combinations of yarns and/or strands are possible.

For a rope comprising strands, the first and the second rope portion may comprise strand portions as well. Strand portions comprised by the first rope portion may be spliced into strand portions comprised by the second rope portion and/or vice versa to form the spliced connection. Alternatively, a strand portion comprised by e.g. the first rope portion may be spliced into a strand portion comprised by the second rope portion, such that a spliced subconnection is formed in the strand portions. This way, multiple spliced subconnections may be formed for obtaining the eye.

For a non-stranded rope, the yarns at the end portion of the rope may be e.g. arranged in strands before forming a spliced connection. This way, an optimal construction may be provided for forming an optimal spliced connection. Also, an optimal construction may be provided when the rope is a stranded rope. For example, the strands can be disentangled and a new construction of strands and/or different strands may be provided. Alternatively, for example, multiple strands may be assembled to form larger strands for forming the spliced connection. Many variants of constructions are possible and contrary to the known prior art method, the person making the spliced connection is not limited anymore to the construction of the rope itself, but can make its own construction for an optimal spliced connection.

By interconnecting the strands and/or the yarns and thus forming the spliced connection, preferably by weaving and/or braiding the strands and/or the yarns into each other, the strands and/or yarns can be stuck to each other thus forming a firm and stable connection.

In an embodiment, the first rope portion has at least one first strand portion and the second rope portion has at least one second strand portion that preferably is distinct from the at least one first strand portion. The terms 'first strand portion' and 'second strand portion' may refer to strand portions comprised by respectively the first rope portion and the second rope portion. Preferably the first strand portion and the second strand portion are portions of mutually distinct strands. Preferably, the second strand portions comprised by the second rope portion and the first strand portions comprised by the first rope portion are spliced into each other for forming the spliced connection. For example, a part of the second strand portions of the second rope portion may be spliced in a part of the first strand portions of the first rope portion, and a remaining part of the first strand portions of the first rope portion may be spliced in a remaining part of the second strand portions of the second rope portion, to obtain the spliced connection. Alternatively, as another example, the second strand portions of the second rope portion may be spliced in the first strand portions of the first rope portion, or vice versa.

In an embodiment, a total amount of the first strand portions of the first rope portion is approximately equal to a total amount of the second strand portions of the second rope portion. This may improve the symmetry of the eye. In this way a distribution of mechanical stress inside the eye during use of the rope may be more even. This may improve a strength of the eye.

Preferably, the rope is provided with a jacket that comprises yarns. Such a jacket is known as such. The jacket may provide protection to an inner part of the rope and/or may add to a strength of the rope.

Preferably, a first portion of the yarns of the jacket is provided around the first rope portion and a second portion of the yarns of the jacket is provided around the second rope portion. In this way the yarns of the jacket may add to the strength of the rope in the first and second rope portion. In known prior art ropes, the jacket may have to be cut to be able to splice the second rope portion in the first rope portion. Such cutting may cause a loss of strength of the rope as the jacket may not add to the strength of the rope. According to the invention, such cutting may be prevented. Therefore, the jacket may add to the strength of the rope. Since the jacket may add to the strength of the rope, a thinner rope may be used for obtaining the same or a similar strength as a thicker conventional prior art rope, thereby possibly reducing material and/or production costs. Preferably, the first portion of the yarns of the jacket is only provided around the at least one first strand portion of the first rope portion. Preferably, the second portion of the yarns of the jacket is only provided around the at least one second strand portion of the second rope portion.

Preferably, the first portion of the yarns of the jacket is provided around the at least one first strand portion of the first rope portion and the second portion of the yarns of the jacket is provided around the at least one second strand portion of the second rope portion.

Preferably, the first portion of the yarns of the jacket is approximately equal to the second portion of the yarns of the jacket. This may promote the symmetry of the eye, which may lead to a more even stress distribution in the eye during use. This may improve a strength of the eye.

Preferably, the first portion of the yarns of the jacket may be provided individually around each first strand portion of the first rope portion, and the second portion of the yarns of the jacket may be provided individually around each second strand portion of the second rope portion. Having the yarns of the jacket distributed approximately evenly in this way may improve the symmetry of the eye and/or the stress distribution in the eye.

Preferably, the rope is terminated at opposite end sides by two similarly formed eyes. In this way one or more advantages of the eye can be exploited at both end sides of the rope. For example, at one end side the rope may be connected with one eye to a towboat and at the other end side with the other eye to a cargo ship. Then, both a user of the towboat and a user of the cargo ship may benefit from the rope.

In an embodiment, the first rope portion and second rope portion comprise a synthetic material. Preferably, substantially the whole rope is made from synthetic materials. Synthetic materials may combine a relatively high strength with a relatively low weight.

It is another object of the present invention to provide an improved method of forming an eye in a rope.

Accordingly, the invention provides a method of forming an eye in a rope having a first rope portion and a second rope portion, the method comprising splicing the second rope portion and the first rope portion into each other for forming a spliced connection in the rope for obtaining the eye, wherein the first rope portion and the second rope portion are obtained from an end portion of the rope. In this way a spliced connection can be obtained that is significantly thinner than would be obtained by using a conventional way of making the eye via a spliced connection. A thinner spliced connection significantly decreases a vulnerability of the rope for grinding or other damaging processes. For a relatively thick spliced connection a chance to grind against other objects is relatively high. Additionally, increased stiffness caused by the relatively thick spliced connection of known prior art ropes may be prevented, resulting in increased handling properties.

Preferably, in the spliced connection, the first rope portion and the second rope portion are directed in different directions along the eye. However, alternatively, the first rope portion and the second rope portion may be directed in approximately the same direction in the spliced connection.

In an embodiment, the first rope portion and the second rope portion are obtained by separating, before splicing, an end portion of the rope into the first rope portion and the second rope portion. In this embodiment, the first rope portion and the second rope portion are rejoined in the spliced connection. Alternatively, the method may be carried out by using a rope that has the first and second rope portion respectively comprised by separate rope branches at the end of the rope. If the rope contains a core, separating the end portion of the rope may include separating the core as well, preferably into two similar core portions. At least part of these core portions may be distributed evenly among the first and second rope portions.

Preferably, the method comprises splicing at least one second strand portion of the second rope portion and least one first strand portion of the first rope portion into each other for forming the spliced connection, wherein preferably the at least one first strand portion of the first rope portion is distinct from the at least one second strand portion of the second rope portion. Using a rope wherein such first and second strand portions are provided in respectively the first and second rope portion enables various ways of splicing, by which a strong connection can be obtained. Splicing may comprise weaving and/or braiding the strand portions and/or rope portions into each other.

Preferably, the method comprises splicing the second strand portions of the second rope portion in the first strand portions of the first rope portion for forming the spliced connection. Using more than one, such as three, eight, or twelve, strand portions per rope portion for splicing enables the formation of a rather strong spliced connection.

Preferably, the method comprises releasing at least a first portion of the yarns of the jacket and releasing at least a second portion of the yarns of the jacket over an end portion of the rope, and providing the first portion of the yarns of the jacket around the first rope portion and providing the second portion of the yarns of the jacket around the second rope portion. During releasing or disentangling the first and second portion of the yarns of the jacket, breaking or cutting of the yarns of the jacket is preferably prevented. In this way, after providing the first and second portions of the yarns of the jacket around the first and second strand portions, the yarns of the jacket can optimally contribute to a strength of the eye.

Preferably, the method comprises releasing the at least first portion of the yarns of the jacket and releasing the at least second portion of the yarns of the jacket, and providing the first portion of the yarns of the jacket around the at least one first strand portion of the first rope portion and providing the second portion of the yarns of the jacket around the at least one second strand portion of the second rope portion. After disentangling the yarns of the jacket over the end portion, the yarns of the jacket may then be divided in a first portion and a second portion. The first portion of the yarns of the jacket may be arranged around the first rope portion. If the first rope portion comprises portions of multiple strands, the first jacket portion may be, e.g. approximately evenly, distributed over the strands. Since the first and the second rope portion are provided with the yarns of the jacket, the yarns of the jacket may add to the strength of the rope and/or the eye.

Preferably, the method comprises providing the first portion of the yarns of the jacket individually around each first strand portion of the first rope portion, and providing the second portion of the yarns of the jacket individually around each second strand portion of the second rope portion. In this way an approximately even distribution of the first and second portions of the yarns of the jacket can be obtained. For example, each strand portion may be surrounded with yarns from the jacket such that a single strand portion may be jacket-like covered. Also, the second jacket portion may be distributed in a similar way over the second rope portion. Then the jacket-like covered strand portions from the first and second rope portion may be spliced into each other to form the spliced connection. Since the strand portions in the spliced connection are covered with yarns from the jacket, the jacket may add to the strength of the eye and/or the rope.

In an embodiment, the method comprises providing a cover over at least part, and preferably the whole, of the spliced connection. In this way the spliced connection can be protected so that its lifetime may be improved. Preferably, the cover is applied tightly so that it pushes the first and second rope portion together. This may increase a strength of the spliced connection. This is especially relevant when the first and second rope portion comprise yarns that may be approximately parallel, and the spliced connection is formed by sliding the yarns with respect to each other in opposite directions.

Other embodiments of the method are described in the claims. Advantages of the method and its embodiments may be realised by the rope having the eye that is obtained after carrying out the method.

Other advantageous embodiments are described in the dependent claims.

BRIEF DESCRIPTION OF THE DRAWINGS

The invention will now be described, in a non-limiting way, with reference to the accompanying drawings, in which.

DETAILED DESCRIPTION

Figure 1A:
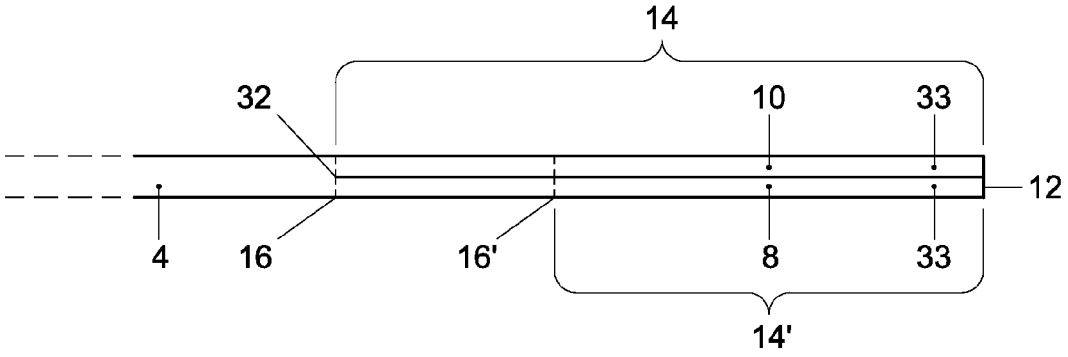
FIG. 1A shows a rope that has a first rope portion and a second rope portion, illustrating a first embodiment of a method of forming an eye in a rope according to the invention.

Unless stated otherwise, like reference numerals refer to like elements throughout the drawings.

FIGS. 1A-F illustrates a first embodiment of a method of forming an eye 2 in a rope 4 according to the invention, referred to as the first method. FIG. 1A shows the rope 4 that has a first rope portion 8 and a second rope portion 10, to be spliced into each other. In this example, the first rope portion 8 has at least one first strand portion and the second rope portion 10 has at least one second strand portion (examples of the first and second strand portions are shown in FIGS. 3A-C and 4A-4B with respectively reference number 26A and 26B).

In this embodiment, the at least one second strand portion may be distinct from the at least one first strand portion. Thus, in this embodiment, a second strand portion of the second strand portions and a first strand portion of the first strand portions may not be a portion of one and the same strand. This is contrary to known prior art ropes, wherein the first rope portion and the second rope portion comprise portions of the same strands. In known prior art ropes the strands that are present in the first rope portion continue along the rope over the distance between the first and the second rope portion and are thus also present in the second rope portion.

Contrary to known prior art methods, in the first method the first rope portion 8 and the second rope portion 10 are obtained from an end portion 14 of the rope 4. In general, the end portion 14 typically extends from an end 12 of the rope 4 along the rope 4 until the first rope portion 8 and the second rope portion 10 end. The first and second rope portion 8, 10 may end at a position 16 that approximately coincides with a branching point 32 of the rope. Alternatively, the first and second rope portion 8, 10 may end at another position 16' along rope branches 33 of the rope spaced apart from the branching point 32. The end portion 14' corresponding with the latter situation is shown as well in FIG. 1A. It is noted that a rope with such first and second end portions is contrary to known prior art ropes, wherein the rope extends over a distance from the first rope portion to the second rope portion, which distance is approximately equal to a circumference of the eye.

Figure 1B:
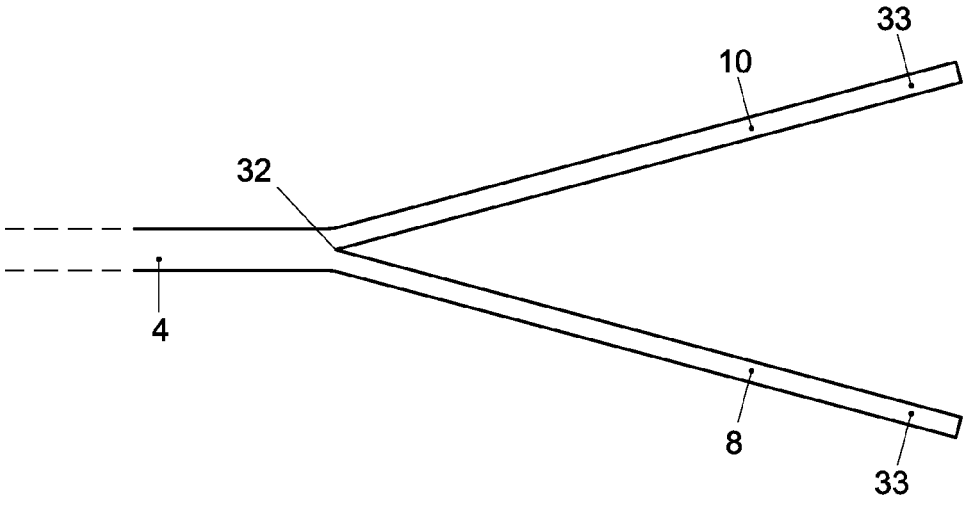
FIG. 1B illustrates separating an end portion of the rope into the first rope portion and the second rope portion, illustrating the first embodiment of a method of forming an eye in a rope according to the invention.

The first method may comprise separating the end portion 14 of the rope into the first rope portion 8 and the second rope portion 10. This is illustrated in FIG. 1B. Such separating may comprise unwinding or disentangling strand portions and/or yarns of the end portion 14. If the rope 4 has a core, an example of which is shown in FIG. 3B with reference number 30, such separating may include separating the core as well. However, the first method may also lack separating the end portion 14, for example when the first method starts from a rope that is already provided with the rope branches 33.

Figure 1C:
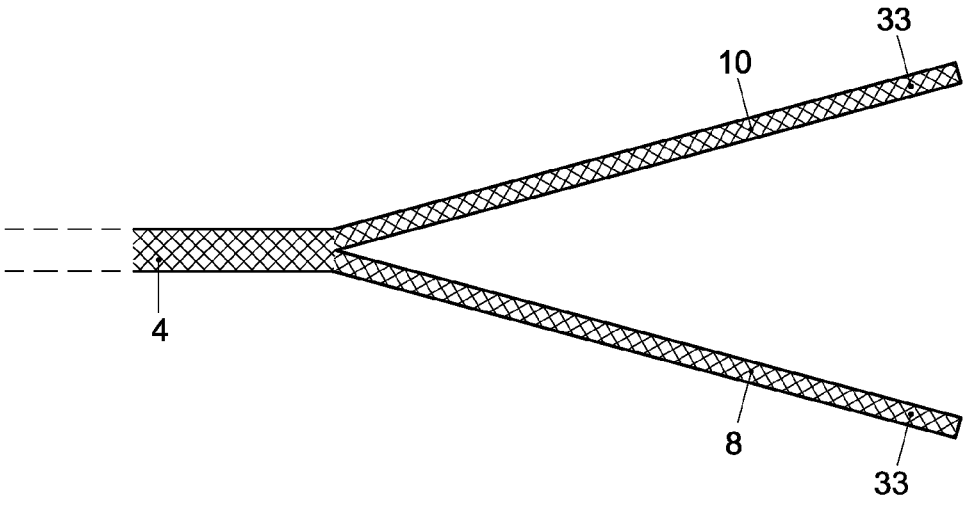
FIG. 1C shows an example in which rope branches comprise twisted strand portions.
Figure 1D:
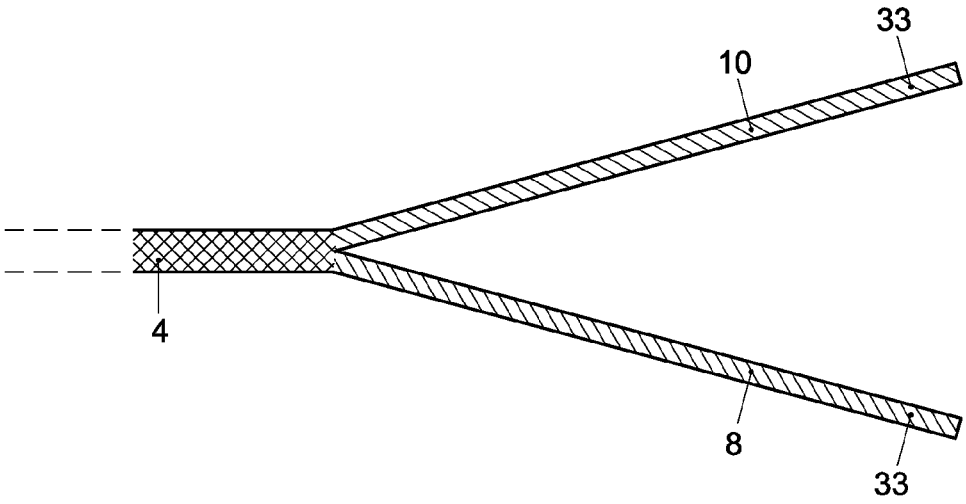
FIG. 1D shows another example in which rope branches comprise braided strand portions.
Figure 1E:
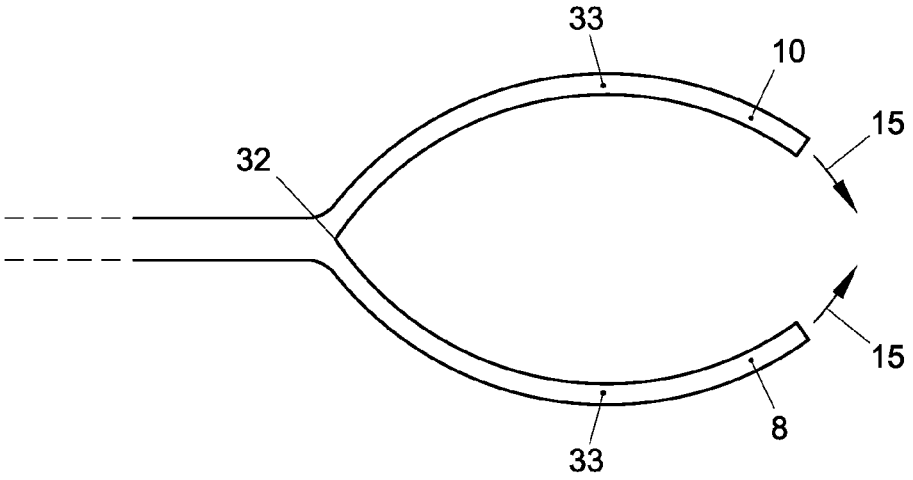
FIG. 1E shows bringing the first rope portion and the second rope portion together, illustrating the first embodiment of a method of forming an eye in a rope according to the invention.

Each one of the rope branches 33 may comprise strand portions, as e.g. indicated in FIGS. 1C and 1D. FIG. 1C shows an example in which each one of the rope branches 33 comprises twisted strand portions. FIG. 1D shows another example in which each one of the rope branches 33 comprises braided strand portions. Alternatively, one of the rope branches 33A may comprise twisted strand portions and another one of the rope branches 33B may comprise braided strand portions (as shown in FIG. 1F).

The first method further comprises splicing, after the optional separating, the second rope portion 10 and the first rope portion 8 into each other. Such splicing may comprise bringing the first rope portion 8 and the second rope portion 10 together. Such bringing together is indicated by arrows 15 in FIG. 1E. The term 'first strand portion' may thus refer to a portion of a strand that is to be located or is located in the spliced connection. The term 'second strand portion' may thus refer to a portion of a strand that is to be located or is located in the spliced connection.

Various ways of splicing the first and second rope portion into each other may be used in the first method. According to a first way of splicing, the second strand portions of the second rope portion 10 may be spliced in the first strand portions of the first rope portion 8 for forming a spliced connection (not shown in FIGS. 1A-F but shown in FIG. 2 with reference number 17), preferably by weaving and/or braiding the portions into each other. This may comprise, prior to splicing, providing the first rope portion 8 in a braided or twisted configuration, as shown in FIGS. 1C and 1D. This may further comprise, prior to splicing, providing the second strand portions of the second rope portion 10 in a disentangled state (not shown in FIGS. 1C and 1D). Then, the disentangled second strand portions of the second rope portion 10 can be spliced in the braided or twisted first rope portion 8. Thus, prior to splicing, the second rope portion may be approximately completely disentangled, e.g. unbraided and untwisted, while the first rope portion may be approximately completely braided or twisted. It may thus be clear that splicing may comprise weaving and/or braiding the first and second rope portion into each other.

Figure 1F:
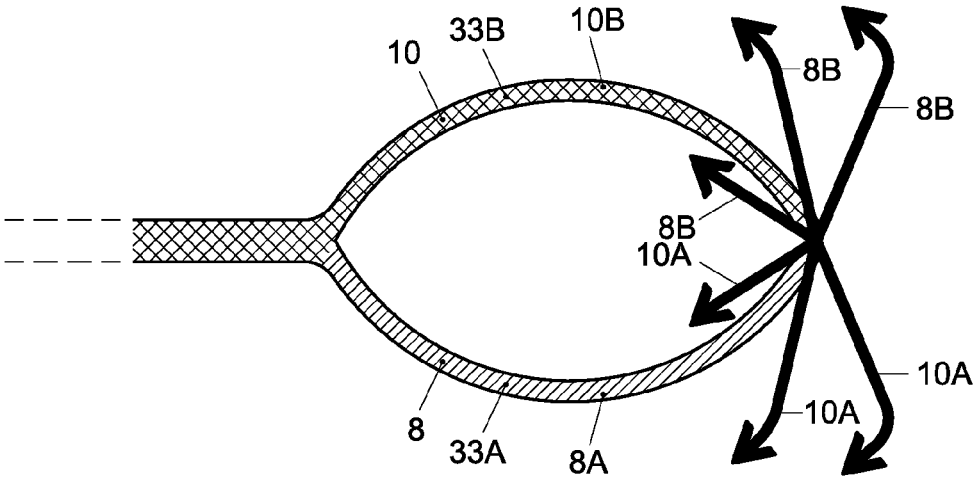
FIG. 1F illustrates a second way of splicing the first and second rope portion into each other, which may be used in the first method.

FIG. 1F illustrates a second way of splicing the first and second rope portion into each other, which may be used in the first method. According to FIG. 1F, a part 10A the second rope portion 10 may be spliced in a part 8A of the first rope portion 8, preferably by weaving and/or braiding the parts into each other. Also, a remaining part 8B of the first rope portion may be spliced in a remaining part 10B of the second rope portion. This may comprise, prior to splicing, providing the part 8A of the first rope portion and the remaining part 10B of the second rope portion in a braided or twisted configuration. This may further comprise, prior to splicing, providing the part 10A of the second rope portion and the remaining part 8B of the first rope portion in a disentangled state, e.g. in an unbraided and untwisted state. Then, the disentangled part of the second strand portions of the part 10A of the second rope portion 10 can be spliced in the braided or twisted part 8A of the first rope portion 8. Then, also the disentangled part of the first strand portions of the remaining part 8B of the first rope portion may be spliced in the braided or twisted remaining part 10B of the second rope portion. It may thus be clear that splicing may comprises weaving and/or braiding the first and second rope portion into each other.

After separating the end portion 14 as shown in FIGS. 1B-1D but before splicing, it is thus not necessary to provide both branches 33 in a completely twisted or braided configuration as shown in FIGS. 1C and 1D. Instead, as explained for the first way of splicing, before splicing the first strand portions of the first rope portion 8 or the second strand portions of the second rope portion 10 may be mutually separated or disentangled, i.e. the first strand portions or the second strand portions may be untwisted and unbraided. Alternatively, as explained for the second way of splicing, before splicing a part of the first strand portions comprised by the part 10A of the second rope portion and a part of the second strand portions comprised by the remaining part 8B of the first rope portion may be mutually separated, i.e. untwisted and unbraided.

Preferably, a length of the part 10A of the second rope portion and a length of the part 8A of the first rope portion are approximately equal to a length of the remaining part 8B of the first rope portion and a length of the remaining part 10B of the second rope portion. This is however not necessary.

By splicing, the first strand portions and the second strand portions may be arranged in a uniform pattern. Such splicing is known as such and may be considered as interconnecting a second rope portion with a first rope portion, by weaving and/or braiding. For example, splicing may include guiding a single second strand portion through spaces between the first strand portions while, possibly repeatedly, crossing one or more of the first strand portions. Such guiding may be carried out for each one of the second strand portions. Each one of the second strand portions may be guided through a distinct sequence of spaces between the first strand portions. Thus, each second strand portion may follow a different trajectory through the first rope portion 8 than the other second strand portions. Analogously, splicing may include guiding a single first strand portion through spaces between the second strand portions while, possibly repeatedly, crossing one or more of the second strand portions. Of course, many other methods of splicing may be available and may be used. It may thus be clear that splicing may comprise weaving and/or braiding the first and second rope portion into each other.

More in general, the spliced connection 17 may be formed by splicing mutually separated first and second rope portions 8, 10 terminating in the rope end 12 into each other. As the first and second rope portions 8, 10 in general may have a thickness less than the original rope thickness, the spliced connection can be thinner than for known prior art ropes. As the first and second rope portion 8, 10 may be obtained by longitudinally separating the rope 4 from its end 12 along the end portion 14, the spliced connection that extends along the eye 2 may even have a thickness $W_1$ being similar to the original rope thickness $W_2$, i.e. the thickness of a base part 25 of the rope 4 (FIG. 2).

More in general, a splicing pattern of the first strand portions and the second strand portions in the spliced connection 17 may be different from a pattern, e.g. a braiding or twisting pattern that strands, of which the first and second strand optionally are a portion, have in the base part 25 of the rope 4. Thus, the strands each comprising one of the first rope portions and the strands each comprising one of the second rope portions may be mutually interconnected in the spliced connection 17 differently than in the base part 25 of the rope 4. In a variation, a method according to the invention, for example the first method, may include optimizing a strength of the eye by varying the splicing pattern of the first and second rope portion, e.g. the splicing pattern of the first and second strand portions, in the spliced connection 17. During such optimizing, the base part 25 may be left substantially unchanged.

Figure 2:
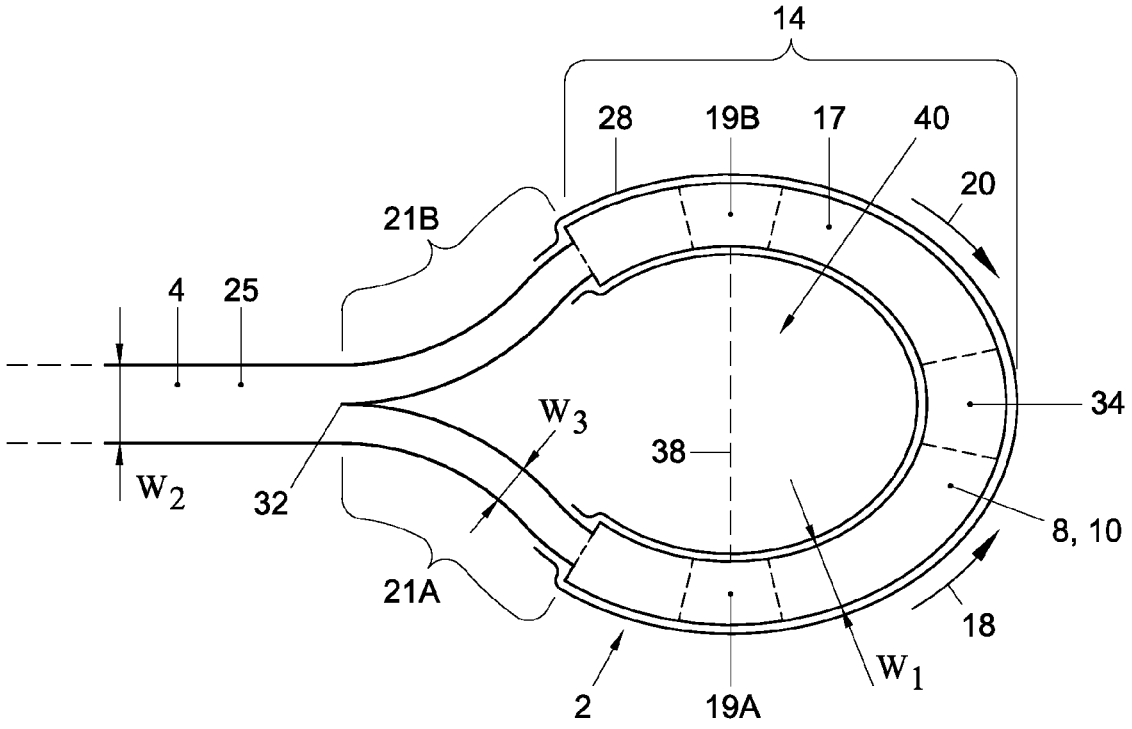
FIG. 2 shows a rope having an eye in a first embodiment according to the invention.

FIG. 2 shows a rope 4 having an eye 2 in a first embodiment according to the invention. By carrying out the first method, the rope in the first embodiment can be obtained. After splicing, the first rope portion 8 extends in a first direction 18 along the spliced connection 17 and the second rope portion 10 extends along a second direction 20 along the spliced connection 17. In the first method, the first rope portion 8 and the second rope portion 10 extend in different, for example mutually opposite, directions along the spliced connection 17. It may be clear that the first and second directions 18, 20 are evaluated along a total length of the spliced connection 17. In the embodiment of FIG. 2, a terminating part 34 of the eye 2 comprises both the first rope portion 8 and the second rope portion 10.

It may be clear that, in the first embodiment of the rope, the second rope portion 10 and the first rope portion 8 are spliced into each other for forming the spliced connection 17 for obtaining the eye 2, wherein the first rope portion 8 and the second rope portion 10 are formed from the end portion 14 of the rope. In the first embodiment of the rope 4, the spliced connection 17 extends along at least part of the eye 2. Variations can be obtained depending on how far the spliced connection 17 extends along the eye 2. For example, the spliced connection 17 may at least extend along the eye 2 between mutually opposing parts 19A, 19B of the eye. An example of such mutually opposing parts 19A, 19B is shown in FIG. 2. An imaginary straight line 38 may cross a region 40 outlined by the eye 2. The spliced connection 17 may extend from one of the mutually opposing parts to the other one of the mutually opposing parts. It may be clear that parts 21A, 21B of the eye along which the spliced connection 17 does not extend may have a thickness $W_3$ that is smaller than the thickness $W_2$ of the base part 25 of the rope 4.

As another example, the spliced connection 17 may extend along substantially the whole eye. This can be obtained by minimising, e.g. shortening to be substantially equal to zero, a length of the parts 21A, 21B of the eye 2 along which the spliced connection 17 does not extend. Then, the spliced connection 17 may extend until the branching point 32 and/or the base part 25 of the rope. This can be obtained by choosing in the first method the position 16 at which the first and second rope portion 8, 10 end adjacent to, e. g. approximately coinciding with, the branching point 32. The example wherein the spliced connection 17 extends along substantially the whole eye is considered advantageous as an optimal strength of the eye can be obtained in this way.

In general, the branching point 32 of the rope 4 may be considered as distinguishing the base part 25 of the rope from the eye 2 of the rope.

Preferably, in the first embodiment of the rope having an eye, the first rope portion 8 is approximately equal to the second rope portion 10. This may for example be obtained by having a total amount of the first strand portions of the first rope portion 8 approximately equal to a total amount of the second strand portions of the second rope portion 10. In this way, in use of the rope 4, stress within the eye may be more evenly distributed among the first and second rope portion 8, 10. In this way a strength of the eye may be improved. The total amount of the first strand portions of the first rope portion 8 may for example be in a range from three to twelve, for example three, six, or twelve. Alternatively, the total amount of first strand portions of the first rope portion 8 may be smaller than three or larger than twelve.

There may even be only a single strand portion in the first rope portion 8, and/or only a single strand portion in the second rope portion 10. Then, splicing the second rope portion 10 and the first rope portion 8 into each other may e.g. comprise twisting the first strand portion of the first rope portion 8 and the second strand portion of the second rope portion 10 into each other. The first strand portion may comprise a plurality of first yarns and the second strand portion may comprise a plurality of second yarns. Then, alternatively or additionally to twisting, splicing the second rope portion 10 and the first rope portion 8 into each other may comprise sliding of the first yarns and second yarns with respect to each other. Thus, a bundle of yarns may be obtained wherein the first yarns and the second yarns are rather uniformly distributed.

Figure 3A:
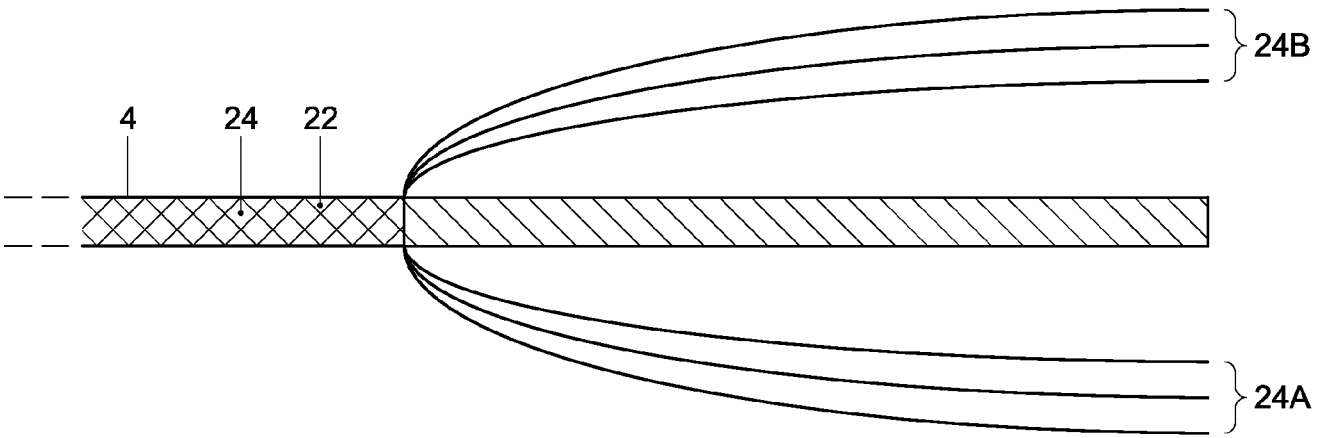
FIG. 3A shows a rope that may be obtained after releasing at least a first portion of yarns of a jacket and releasing at least a second portion of the yarns of the jacket.
Figure 3B:
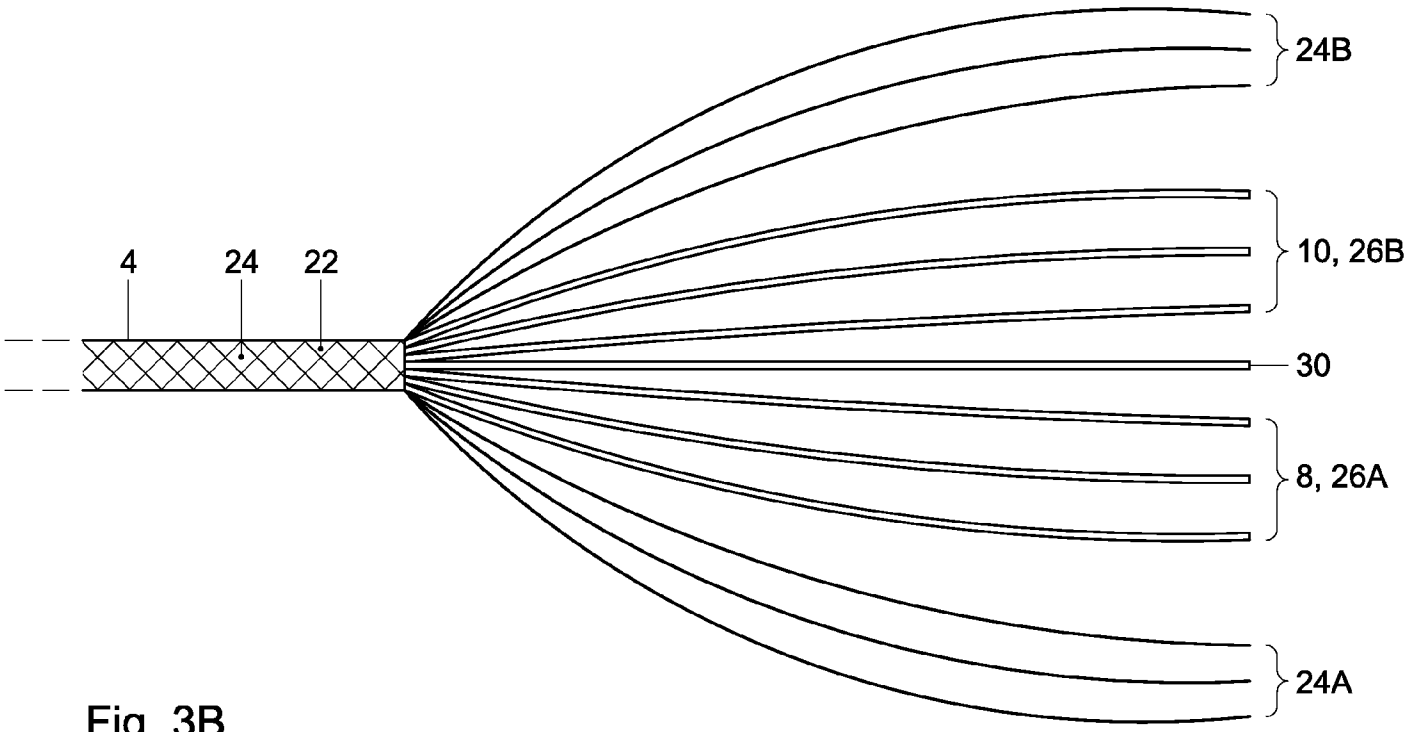
FIG. 3B shows a rope that may be obtained after separating an end portion of the rope into a first rope portion and a second rope portion.
Figure 3C:
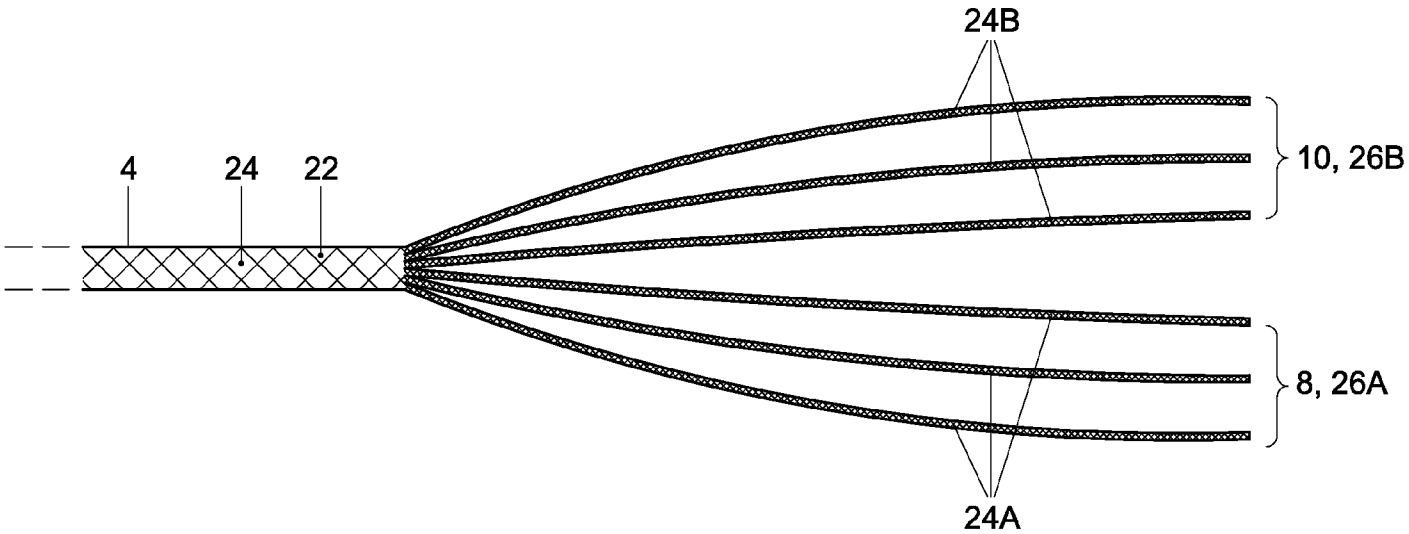
FIG. 3C shows a rope wherein first and second strand portions are individually covered by respectively the first and the second portion of the yarns of the jacket.

FIGS. 3A-C illustrates a second embodiment of a method of forming an eye 2 in a rope 4 according to the invention, referred to as the second method. In the second method, the rope 4 is provided with a jacket 22 that comprises yarns 24. The second method may comprise the step of releasing at least a first portion 24A of the yarns 24 of the jacket and releasing at least a second portion 24B of the yarns of the jacket. After such releasing, a rope depicted in FIG. 3A may be obtained.

The second method may further comprise separating the end portion 14 of the rope into the first rope portion 8 and the second rope portion 10. Then, the rope 4 shown in FIG. 3B may be obtained. It may be clear that in this example, the first rope portion 8 comprises three first strand portions 26A, and the second rope portion 10 comprises three second strand portions 26B. In this example, the first rope portion 8 may be approximately equal to the second rope portion 10, as here a total amount of strand portions in the first rope portion 8 equals a total amount of strand portions in the second rope portion 10.

When carrying out the first method, the second method, or another method according to the invention, a rope may be used wherein each first strand portion 26A may comprise a plurality of first substrand portions. Additionally, each second strand portion 26B may comprise a plurality of second substrand portions. A single strand may comprise multiple strands, i.e. substrands, itself. The term 'first substrand portion' thus may refer to a portion of a substrand. The term 'second substrand portion' may refer to a portion of another substrand. The first substrand portions of one first strand portion may be mutually braided or twisted or otherwise interconnected. Also, the second substrand portions of one second strand portion may be mutually braided or twisted or otherwise interconnected. This may hold for each first strand portion and each second strand portion.

Substrands may be provided approximately in parallel within the base part 25 of the rope 4. However, in the spliced connection the first substrand portions may be arranged into first strand portions, and the second substrand portions may be arranged into second strand portions. Then, the first strand portion may comprise most of, e.g. all of, its strand. Similarly, the second strand portion may comprise most of, e.g. all of, its strand. A multitude of variations is possible for arranging the first and second substrand portions in the spliced connection. These variations are substantially independent from a configuration that the strands and substrands have in the base portion 25 of the rope. It may thus be clear from these examples that, more in general, a configuration, such as a braiding or twisting pattern, that strands and/or substrands have in the base part 25 of the rope 4 may be different from a configuration, such as a splicing pattern, of first and second strand portions, and/or first and second substrand portions, in the spliced connection. Different configurations of first and second strand portions, and/or first and second substrand portions, in the spliced connection can be tested, so that an optimal strength of the eye can be obtained.

The core 30 may be included in the rope 4. The core may comprise core yarns. In general, the first and/or second method may comprise the step of distributing the yarns of the core 30, preferably evenly, among each individual one of the first strand portions and the second strand portions.

The second method may further comprise providing the first portion 24A of the yarns of the jacket 22 around the first strand portions 26A of the first rope portion 8 and providing the second portion 24B of the yarns of the jacket 22 around the second strand portions 26B of the second rope portion 10. Preferably, the first portion 24A of the yarns of the jacket 22 is approximately equal to the second portion 24B of the yarns of the jacket 22. Thus, a total amount of yarns of the first portion 24A of the yarns of the jacket 22 may be approximately equal to a total amount of yarns of the second portion 24B of the yarns of the jacket 22.

In this example, the first portion 24A of the yarns of the jacket 22 is provided individually around each first strand portion 26A of the first rope portion 8. That means that one yarn of the first portion 24A of the yarns of the jacket 22 may surround only one of the first strand portions 26A when being provided around that first strand portion 26A. Analogously, in this example the second portion 24B of the yarns of the jacket is provided individually around each second strand portion 26B of the second rope portion 10. After this step, the rope 4 shown in FIG. 3C may be obtained, wherein the first and second strand portions 26A, 26B are individually covered by respectively the first and second portion 24A, 24B of the yarns of the jacket.

The second method may further comprise forming the eye according to the first method by using the rope 4 shown in FIG. 3C. Then, a rope in a second embodiment according to the invention is obtained.

In the second embodiment of the rope 4 having the eye 2, the first rope portion 8 and the second rope portion 10 are formed from the end portion 14 of the rope 4. In the rope 4 thus obtained, the first portion 24A of the yarns of the jacket may be provided individually around each first strand portion 26A of the first rope portion 8. Furthermore, the second portion 24B of the yarns of the jacket may be provided individually around each second strand portion 26B of the second rope portion 10. In this way the first and second portions 24A, 24B of the yarns add to a strength of the eye 2. Cutting the jacket for being able to reach the first rope portion when splicing the second rope portion and the first rope portion into each other, may be prevented.

Figure 4A:
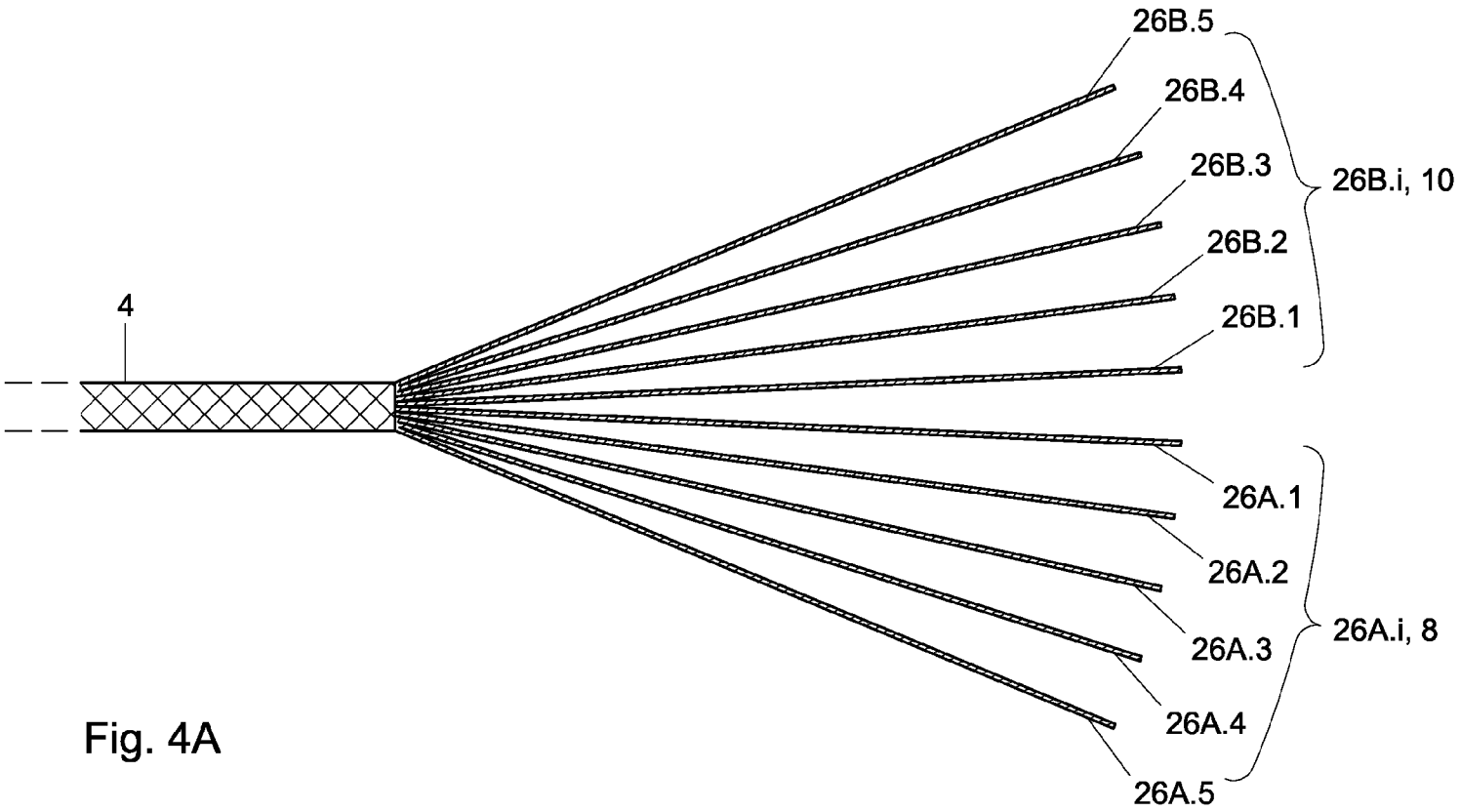
FIG. 4A illustrates a third embodiment of a method of forming an eye in a rope according to the invention.

FIG. 4A illustrates a third embodiment of a method of forming an eye 2 in a rope 4 according to the invention, referred to as the third method. FIG. 4A shows the rope 4 having five first strand portions 26A comprised by the first rope portion 8 and five second strand portions 26B comprised by the second rope portion. Each one of the first and second strand portions may comprise a number of first respectively second substrand portions, in this example three mutually twisted first respectively second substrand portions.

The rope 4 may have the jacket 22. The first and second strand portions 26A, 26B may be formed by strands that extend approximately parallel along the rope 4 inside the jacket 22 of the base part 25 of the rope 4, although alternatively they may have a different configuration. Analogously, the first and second substrand portions may be formed by substrand portions that extend inside the jacket 22 approximately parallel along the length of the base part of the rope 4, although alternatively they may have a different configuration.

Figure 4B:
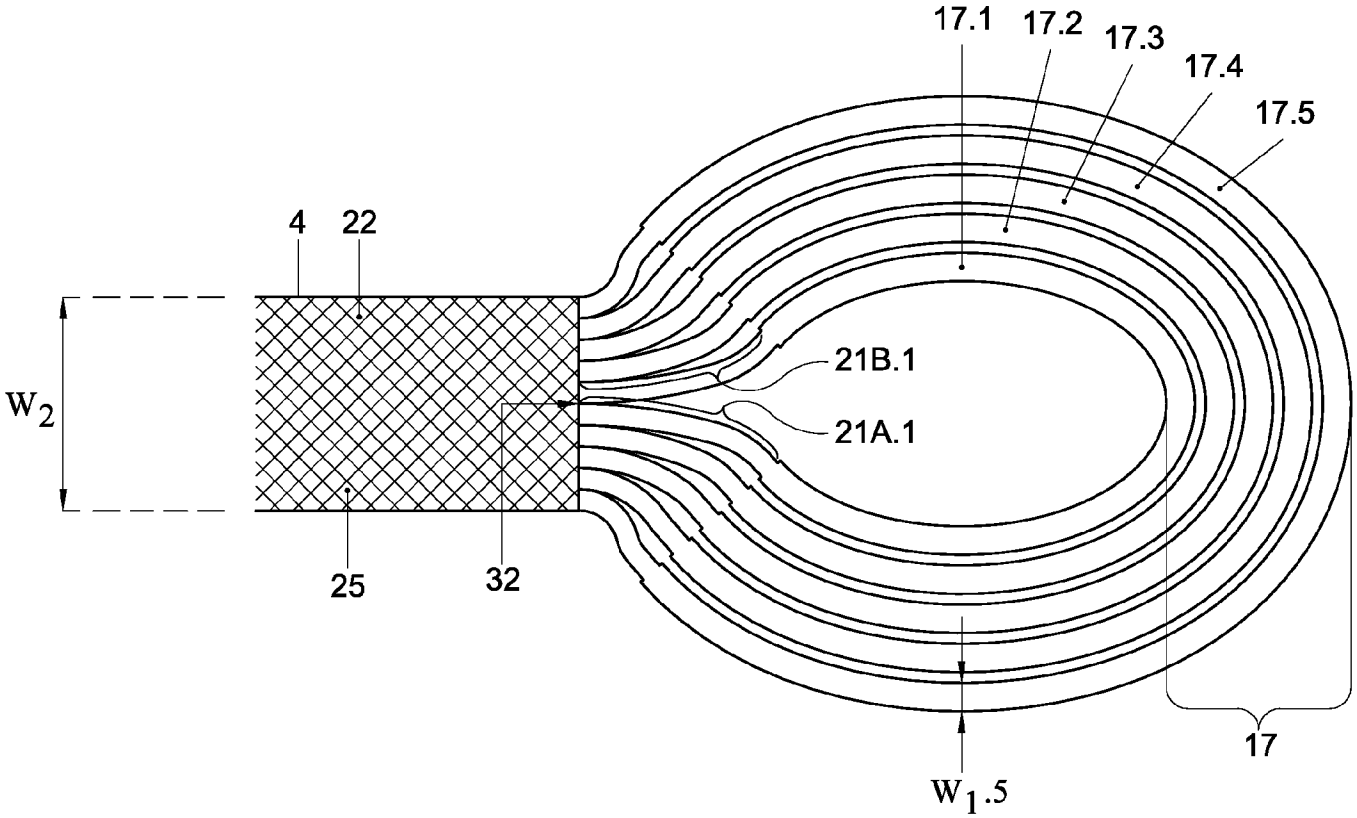
FIG. 4B shows a plurality of spliced subconnections.

The fourth method comprises splicing one of the first strand portions 26A.i and one of the second strand portions 26B.i into each other. This may be carried out for each first strand portion 26A.i and each second strand portion 26B.i. In this way a plurality, in this example five, spliced subconnections 17.*i* can be obtained, as shown in FIG. 4B. In this way a rope in a third embodiment can be obtained, wherein the spliced connection 17 is formed by the spliced subconnections 17.*i*.

A cross-sectional area A.i may be associated with a width $W_1$.i of one of the spliced subconnections 17.*i*. The sum of the area's A.i may be approximately equal to a cross-sectional area A of the base part of the rope that may be associated with the width $W_2$ of the base part 25 of the rope 4. The subparts 21A.i, 21B.i of the eye along which the spliced subconnections 17.*i* do not extend may be substantially minimised, e.g. may be limited to be substantially equal to zero. As a result, the spliced connection 17 of the rope in the third embodiment may extend along substantially the whole eye.

For the first, second, and third embodiment of the rope 4, at least part, and preferably the whole, of the spliced connection 17 may be provided with a cover 28, e.g. shown in FIG. 2. The cover 28 may have one or more functions. First, the cover 28 may provide protection to the spliced connection 17 against mechanical damage. Second, the cover 28 may be provided tightly around the spliced connection 17. In this way, yarns and/or strand portions in the spliced connection 17 can be held together. In this way a mutual resistance of the yarns and/or strand portions in the spliced connection 17 is increased. This is especially useful if in the spliced connection 17 the yarns of the second rope portion are slid into the yarns of the first rope portion 8. More in general, a method according to the invention may include providing the cover 28 in a collapsed state around one of the rope branches 33 before splicing, and may further include, after splicing, extending the cover 28 over the at least part, and preferably the whole, of the spliced connection 17.

In the first, second, and third embodiment of the rope, only one end side of the rope 4 is described, at which end side the eye 2, the end 12, and the end portion 14 are located. However, the rope 4 may be provided at its other end side with a similar eye 2. Then, the rope 4 may be terminated at opposite end sides by two similarly formed eyes. The first and/or second method may comprise forming similar eyes at both end sides of the rope 4. Such a two-eyed rope 4 is especially suitable for exerting a force, from a ship to one of another ship, an off-shore platform, and an anchor. Then, the rope is connected to the ship with one eye and is connected to the one of the other ship, the off-shore platform, and the anchor with the other eye. More in general the rope 4, with one or two eyes, is especially suitable for maritime applications. The thickness $W_2$ of the base part of the rope 4 may e.g. be in a range between several, e.g. three, and several tens, e.g. thirty, centimeter.

One or optionally both eyes of the rope 4 may be provided with a socket (not shown but known as such to the skilled person) inside the eye. Such a socket is for example substantially made of a metallic material. Especially in case the spliced connection 17 extends along substantially the whole eye, the rope 4 having the eye 2 may advantageously be provided with the socket. Surprisingly, it turns out that the eye 2 formed according to the invention is better shaped at a branching point 32 of the eye 2 for receiving the socket.

In general, the first rope portion 8 and second rope portion 10 may comprise a synthetic material. The rope may e.g. be substantially made of the synthetic material. Such a material may for example contain polyamide, polyester, polyethylene, polypropylene, high modulus polyethylene, polyaramide, ultra-high molecular weight polyethylene, and aramid. More in particular the synthetic material may, alternatively or additionally, contain Kevlar and/or Dyneema. The jacket 22 and/or the core 30 may for example contain one or more similar synthetic materials. Alternatively or additionally, the jacket, core and strands may comprise mutually different materials.

Three methods of forming the eye, and variants thereof, have been described. Of course many more methods fall within the scope of the invention defined in the claims. The substrands may e.g. themselves comprise strands, i.e. sub-substrands, and/or yarn bundles. These may be employed when forming the spliced connection 17 and possibly when forming one or more, e.g. all, of the spliced subconnections 17.*i*. These may also be employed for possibly forming sub-subconnections which are comprised by one of the spliced subconnections 17.*i*. For example, first strand portions, first substrand portions, first sub-substrand portions and/or first yarn bundles of the first rope portion 8 and second strand portions, second substrand portions, second sub-substrand portions and/or second yarn bundles of the second rope portion 10 may be spliced into each other for forming the spliced connection 17. Optimising the strength of the eye may comprises defining a division of the first rope portion 8 and the second rope portion 10 into first and second strand portions, first and second substrand portions, first and second sub-substrand portions, and/or first and second yarn bundles. Such optimising may be substantially independent from a configuration of the base part 25 of the rope. Thus, a configuration that strands, substrands, sub-substrand, and/or yarn bundles have in the base part of the rope may be different than in the spliced connection 17. All such variations of the rope and the method of forming an eye in the rope are considered to fall within the scope of the present invention. The invention is not limited to any embodiment herein described and, within the purview of the skilled person, modifications are possible which may be considered within the scope of the appended claims. For example, the rope may be substantially made of steel instead of the synthetic material. As another example, if e.g. after splicing extremities of yarns and/or strand portions sticking partly out of the eye may be cut to establish a relatively smooth outer surface, the first rope portion and the second rope portion are still considered to be formed from an end portion of the rope. Also, in an embodiment, the branching region of the rope may be provided with a whipping e.g. to protect the branching point. When around the eye a cover is provided, the cover may be connected to the whipping to form an endless cover over the eye and the branching region. Equally all kinematic inversions are considered inherently disclosed and to be within the scope of the present invention. The use of expressions like: "preferably", "in particular", "especially", "typically" etc. is not intended to limit the invention. The indefinite article "a" or "an" does not exclude a plurality. Features which are not specifically or explicitly described or claimed may be additionally included in the structure according to the present invention without deviating from its scope.

The invention claimed is:

1. A rope having an eye, the rope comprising a first rope portion and a second rope portion that are spliced into each other for forming a spliced connection for obtaining the eye, wherein:

the first rope portion and the second rope portion are formed from an end portion of the rope;

the rope is provided with a jacket that comprises yarns;

a first portion of the yarns of the jacket is provided around the first rope portion and a second portion of the yarns of the jacket is provided around the second rope portion;

the first rope portion has at least one first strand portion and the second rope portion has at least one second strand portion that is distinct from the at least one first strand portion, and the first portion of the yarns of the jacket is provided individually around each first strand portion of the first rope portion so that a yarn of the first portion of the yarns of the jacket surrounds only one of the first strand portions, and the second portion of the yarns of the jacket is provided individually around each second strand portion of the second rope portion so that a yarn of the second portion of the yarns of the jacket surrounds only one of the second strand portions.

2. The rope according to claim 1, wherein the spliced connection extends along substantially the whole eye.

3. The rope according to claim 1, wherein the first rope portion is approximately equal to the second rope portion.

4. The rope according to claim 1, wherein a thickness and/or cross section of the first rope portion and the second rope portion are approximately equal.

5. The rope according to claim 1, wherein splicing comprises weaving and/or braiding the first and second rope portion into each other.

6. The rope according to claim 1, wherein the second strand portions comprised by the second rope portion and the first strand portions comprised by the first rope portion are spliced into each other for forming the spliced connection.

7. The rope according to claim 1, wherein each second strand portion follows a different trajectory through the first rope portion than the other second strand portions.

8. The rope according to claim 1, wherein a total amount of the first strand portions of the first rope portion is approximately equal to a total amount of the second strand portions of the second rope portion.

9. The rope according to claim 1, wherein the first portion of the yarns of the jacket is approximately equal to the second portion of the yarns of the jacket.

10. The rope according to claim 1, wherein the rope contains a core separated in the end portion into two similar core portions, wherein at least part of these core portions are distributed evenly among the first and second rope portions.

11. The rope according to claim 1, wherein at least part of the spliced connection is provided with a cover.

12. The rope according to claim 1, provided with a socket inside the eye.

13. The rope according to claim 1, terminated at opposite end sides by two similarly formed eyes.

14. A method of forming an eye in a rope having a first rope portion and a second rope portion, the method comprising splicing the second rope portion and the first rope portion into each other for forming a spliced connection in the rope for obtaining the eye, wherein:

the first rope portion and the second rope portion are obtained from an end portion of the rope;

the rope comprises a jacket having yarns;

the method comprises releasing at least a first portion of the yarns of the jacket and releasing at least a second portion of the yarns of the jacket, and providing the first portion of the yarns of the jacket around the first rope portion and providing the second portion of the yarns of the jacket around the second rope portion;

the method comprises splicing at least one second strand portion of the second rope portion and at least one first strand portion of the first rope portion into each other for forming the spliced connection, wherein the at least one first strand portion of the first rope portion is distinct from the at least one second strand portion of the second rope portion; and the method comprises providing the first portion of the yarns of the jacket individually around each first strand portion of the first rope portion so that a yarn of the first portion of the yarns of the jacket surrounds only one of the first strand portions, and providing the second portion of the yarns of the jacket individually around each second strand portion of the second rope portion so that a yarn of the second portion of the yarns of the jacket surrounds only one of the second strand portions.

15. The method according to claim 14, wherein the first rope portion and the second rope portion are obtained by separating, before splicing, the end portion of the rope into the first rope portion and the second rope portion.

16. The method according to claim 14, wherein the spliced connection extends along substantially the whole eye.

17. The method according to claim 14, wherein the first rope portion is approximately equal to the second rope portion.

18. The method according to claim 14, wherein a thickness and/or cross section of the first rope portion and the second rope portion are approximately equal.

19. The method according to claim 14, wherein splicing comprises weaving and/or braiding the first and second rope portion into each other.

20. The method according to claim 14, comprising splicing the second strand portions of the second rope portion and the first strand portions of the first rope portion into each other for forming the spliced connection.

21. The method according to claim 14, wherein each second strand portion follows a different trajectory through the first rope portion than the other second strand portions.

22. The method according to claim 14, wherein a total amount of the first strand portions of the first rope portion is approximately equal to a total amount of the second strand portions of the second rope portion.

23. The method according to claim 14, wherein the first portion of the yarns of the jacket is approximately equal to the second portion of the yarns of the jacket.

24. The method according to claim 14, wherein the rope contains a core, and wherein separating the end portion of the rope includes separating the core into two similar core portions, wherein at least part of these core portions are distributed evenly among the first and second rope portions.

25. The method according to claim 14, comprising providing a cover over at least part of the spliced connection.

26. The rope according to claim 1, wherein the first rope portion and the second rope portion comprise a synthetic material.

27. The use of a rope according to claim 1, for exerting a force from an object on another object, with which the rope is connected by means of the eye.

28. The method according to claim 14, wherein the first rope portion and the second rope portion comprise a synthetic material.

29. The use of a rope manufactured according to claim 14, for exerting a force from an object on another object, with which the rope is connected by means of the eye.

30. The rope according to claim 1, wherein the whole spliced connection is provided with a cover.

31. The method according to claim 14, comprising providing a cover over the whole spliced connection.

* * * * *